US008191204B2

(12) United States Patent
Belfiore et al.

(10) Patent No.: US 8,191,204 B2
(45) Date of Patent: Jun. 5, 2012

(54) SELECTIVE COMPLIANCE HINGE

(75) Inventors: Nicola Plo Belfiore, Rome (IT); Massimiliano Scaccia, Rome (IT); Francesco Ianniello, Rome (IT); Massimiliano Presta, Rome (IT)

(73) Assignee: Universita' Degli Studi di Roma "La Sapienza", Rome (IT)

( * ) Notice: Subject to any disclaimer, the term of this patent is extended or adjusted under 35 U.S.C. 154(b) by 133 days.

(21) Appl. No.: 12/677,961

(22) PCT Filed: Sep. 12, 2008

(86) PCT No.: PCT/IB2008/053697

§ 371 (c)(1),
(2), (4) Date: Sep. 2, 2010

(87) PCT Pub. No.: WO2009/034551

PCT Pub. Date: Mar. 19, 2009

(65) Prior Publication Data

US 2010/0325840 A1 Dec. 30, 2010

(30) Foreign Application Priority Data

Sep. 14, 2007 (IT) ..... RM2007A0475

(51) Int. Cl.
*E05D 1/00* (2006.01)

(52) U.S. Cl. ..... 16/225; 16/342; 16/385; 16/374; 16/355

(58) Field of Classification Search ..... 16/225, 16/DIG. 13, 342, 371, 374, 335, 352, 355, 16/385; 220/836, 837, 840–842, 4.23, 4.24; 600/146–149; 604/528, 95.04; 606/1, 46, 606/167, 170, 174; 294/15–17, 34, 57
See application file for complete search history.

(56) References Cited

U.S. PATENT DOCUMENTS 3,616,487 A * 11/1971 Dearth ..... 16/225
3,741,447 A * 6/1973 Miles et al. ..... 222/517
3,752,371 A 8/1973 Susuki et al.
4,158,902 A 6/1979 Chernack et al.
4,315,345 A * 2/1982 Schijf ..... 16/267

(Continued)

FOREIGN PATENT DOCUMENTS

DE 22 53 360 5/1974

(Continued)

OTHER PUBLICATIONS

International Search Report for PCT/IB2008/053697, mailed Jan. 22, 2009.

*Primary Examiner* — Chuck Y. Mah
(74) *Attorney, Agent, or Firm* — Nixon & Vanderhye P.C.

(57) ABSTRACT

A selective compliance hinge, apt to define a turning pair with a default axis of rotation (A), allows to obtain a selective compliance turning pair, hence with the advantages typical of such applications but providing the best precision and movement repeatability, and comprises a connecting element (3) compliant between a first and a second body (1, 2), and characterized by that each of said bodies (1, 2) has a first and a second extension (11, 21), respectively, said extensions (11, 21) comprising respective surfaces (111, 211) conjugate therebetween, so that said surfaces (111, 211) slide one relative the other remaining adjacent therebetween and defining a rotary motion taking place substantially about said default axis of rotation (A).

19 Claims, 4 Drawing Sheets

U.S. PATENT DOCUMENTS

| | | | | |
|---|---|---|---|---|
| 5,148,850 | A * | 9/1992 | Urbanick | 160/231.1 |
| 5,357,377 | A * | 10/1994 | Payne et al. | 359/855 |
| 5,622,012 | A * | 4/1997 | Schijf | 52/71 |
| 2002/0133906 | A1 * | 9/2002 | Fedon | 16/225 |
| 2004/0111836 | A1 * | 6/2004 | Lagler et al. | 16/225 |
| 2007/0283529 | A1 * | 12/2007 | Hashizume et al. | 16/225 |

FOREIGN PATENT DOCUMENTS

| | | |
|---|---|---|
| FR | 2 549 124 | 1/1985 |

* cited by examiner

SELECTIVE COMPLIANCE HINGE

This application is the U.S. national phase of International Application No. PCT/IB2008/053697, filed 12 Sep. 2008, which designated the U.S. and claims priority to Italian Patent Application No. RM2007A000475, filed 14 Sep. 2007, the entire contents of each of which are hereby incorporated by reference.

BACKGROUND OF THE INVENTION

The present invention refers to a selective compliance hinge providing a mechanical linkage between two bodies in relative movement.

In the field of mechanical engineering a plurality of different possible solutions has been developed for providing mobile linkages between two components. In particular, various possible embodiments of linkages capable to allow a relative rotary movement exist. In general, the solutions differ according to the uses required and, therefore, to the related working conditions.

The research of new embodiments for kinematic pairs—compared to the state of art ones—is particularly felt in the field of micro-surgery, wherein it is necessary to use devices having extremely reduced dimensions and that, at the same time, should allow precise and repeatable movements.

Moreover, it is appropriate that the kinematic pairs used in such devices are made of as few as possible components, both since their small dimensions make difficult the assembling of their components, and since known hinges and, in general, other known kinematic pairs, do not guarantee an appropriate reliability when used in complex environments and, in particular, when used in endoscopy, as they should be introduced in visceral cavities. Another field where the research for innovative solutions is particularly felt is the one of space appliances, wherein, although for different reasons, it is advisable to have precise and reliable kinematic pairs, made of as few as possible components.

SUMMARY OF THE INVENTION

In order to avoid the use of complex articulated pairs and, at same time, still assuring mobility between two members, solutions have been developed having a movement capacity by selective compliance thanks to appropriate choices in materials, shapes and dimensions. Such feature allows to use the deformability of materials itself so as to be able to create a movement between two or more parts belonging to a system made as a single body. Accordingly, a component is provided with a connection portion between two parts thereof and, such connection portion has characteristics such that it is enough deformable to allow mobility to said parts.

The advantages of such appliances are evidently connected to the use of an extremely reduced number of components—virtually such appliances are based on a single part—and to the lack of wear and of friction in mobile linkages. This solution, e.g., allows to avoid the use of lubricants in space appliances, wherein it is not possible to use them for obvious reasons. Nevertheless, the main drawback connected to these compliant elastic linkages is that they do not always guarantee relative movements precise enough for some kind of appliance, in particular in the field of micro-surgery. In fact, it should be comprised that although modern modelling techniques allows to obtain good solutions in order to have the compliance in the required direction or rotation, it is always present a "parasitic" compliance, perceptible even in the other directions and rotations. In particular, this drawback is felt in appliances requiring rotary movements, since the linkage always has a non-negligible compliance also in other directions and rotations, rather than the rotary component. This non-negligible compliance could therefore be defined as "parasitic".

Hence, the technical problem underlying the present invention is to provide a kinematic pair allowing to overcome the drawbacks mentioned above with reference to the known art.

Such a problem is solved by the selective compliance hinge according to claim 1.

The present invention provides several relevant advantages. The main advantage lies in that the hinge according to the present invention allows to make a selective compliance turning pair—thus with the advantages of such appliances—even allowing the greatest precision and repeatability for the movements permitted thereby.

Other advantages, features and the operation modes of the present invention will be made apparent from the following detailed description of some embodiments thereof, given by way of a non-limiting example. Reference will be made to the figures of the annexed drawings.

DESCRIPTION OF THE INVENTION

Figure 1:
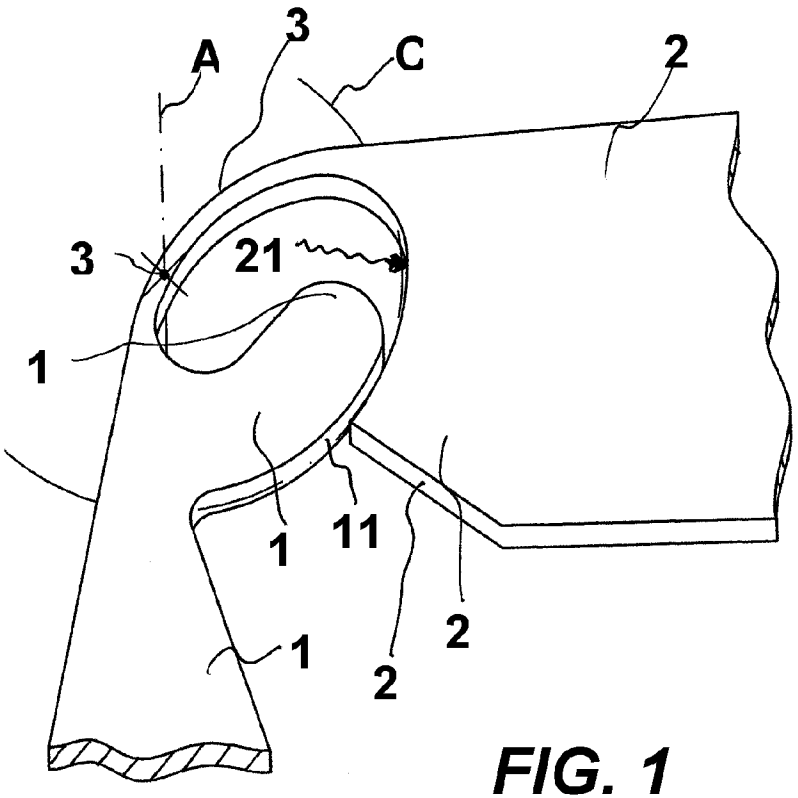
FIG. 1 is a perspective view of a hinge according to the present invention.

Referring initially to FIG. 1, a hinge according to the present invention allows to make a mobile linkage between a first and a second body, overall shown with the references 1 and 2.

As will be seen in detail in the following, the hinge according to the present invention provides mobility between the above mentioned two bodies by a feature of selective compliance.

In order to provide this movement capability, the bodies 1 and 2 are connected therebetween by a compliant connecting element 3. According to a preferred embodiment, bodies 1 and 2, and the connecting element 3 are made as a single body. Moreover, the connecting element is oblong shaped, i.e. in the form of a narrow section region connecting the first and the second bodies.

Thus, bodies 1 and 2 and the connecting element 3 could be easily made, e.g., by plastic materials molding or other anyhow known processes that will not be therefore described in further details in the following.

It should be also noted that selective compliance mobile bodies are known in general and, accordingly, the features allowing the connecting element 3 to provide this function will not be described in details in the following.

Anyhow, it should be noted that, in order to provide a selective compliance, the connecting element 3 will be made so that it could be strained within the elastic or elastoplastic range, but without showing either yield or even failure of the material. In other words, the connecting element 3 is capable of being subjected to the yield required for a continuous and repetitive motion between the first and the second body, without substantially suffering wear phenomena and with a predicted reduction of mechanical fatigue.

Theoretically, the provision of a selective compliance requires that the element providing the movement has a low stiffness along the desired motion direction and is very or infinitely stiff along all other directions. In the present embodiment, the hinge according to the present invention provides a rotating movement, by a selective compliance of the connecting element 3, about the axes shown with the letter A in FIG. 1. The connecting element 3 will have a narrow section in a plane perpendicular to axis of rotation A. The narrow section has a geometry capable of allowing the flexibility required for providing the above mentioned rotation. In particular, it should be observed that the flexibility of the connecting element 3, shown in the present embodiment, guarantee a rotation between the first and the second body.

The kinematic elements in the proper sense, corresponding to extensions 11 and 21, have cylindrical surfaces 111 and 211 allowing relative movements between the extensions themselves, said motion having characteristics of a planar rotary motion with the center of relative rotation substantially located at the barycentre of elastic weights of the connecting element 3.

Therefore, the axis of rotation A will pass through the centre of rotation 31 and will be perpendicular to a developing plane of the hinge.

Always with reference to FIG. 1, it is again specified that each bodies 1, 2 has a first and a second extension 11, 21 respectively, comprising respective surfaces 111, 211 conjugate therebetween.

More precisely, surfaces 111 and 211 are facing therebetween and, as it will be seen in further detail in the following, they will remain as such during the movements of the hinge.

In fact, according to a preferred embodiment, surfaces 111 and 211 develops substantially along arcs of a circle C having the center corresponding with the center of relative rotation 31 defined by the barycentre of elastic weights and previously described. Therefore, during the motion between bodies 1 and 2, defined by the selective compliance of the connecting element 3, such surfaces will slide one against the other remaining adjacent therebetween and thereby defining a rotation about the default axis of rotation A as it passes through the center 31 of the circle C.

Figure 2:
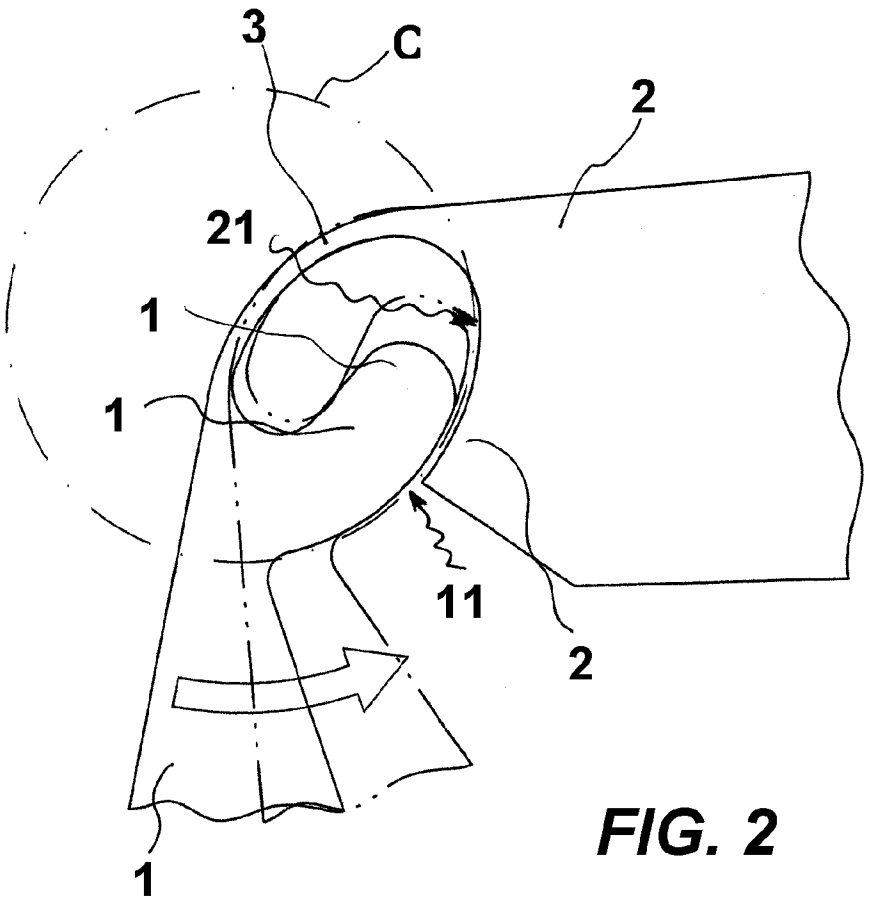
FIG. 2 is a plan view of the hinge of FIG. 1, schematically showing the operation thereof.

Such feature is then described in FIG. 2, wherein it can be appreciated how the movement of rotation about the axis A is not only operated by the characteristic of selective compliance of the connecting element 3, as above described, but also guided by the shape coupling between the surfaces 111 and 211 sliding one against the other, the surfaces following a default path defined by the circle C in this case.

Therefore, the first and the second body will move one relative to the other in a precise and repeatable way, since they are connected to the extensions 11 and 21 and, thus, guided by the above mentioned coupling between the surfaces 111 and 211.

With reference again to FIG. 1, the first extension 11 appears as an extended projection housed in a recess defined by the extension 21 of the second body and by the connecting element 3 itself. Thus, in this case, the coupling between the extensions 11 and 21 occurs at an external surface of the first one, corresponding to the surface 111 and at an internal surface of the second one, corresponding to the surface 211. Moreover, these surfaces will be concave and convex, respectively, thus following the development of the circle C. Nevertheless, it is evident that also different structural solutions anyhow apt to provide the shape coupling previously described could be used.

Moreover, it should be noted that the first extension 11 has an end 12 that after a predetermined rotation between the first and the second body, could enter into contact with the surface 211 within the previously defined recess, thus functioning as a stop for the hinge.

Analogously, the second extension could have a side surface 22 that, after a predetermined rotation, could enter into contact with the first body, further functioning as a stop.

Figure 3:
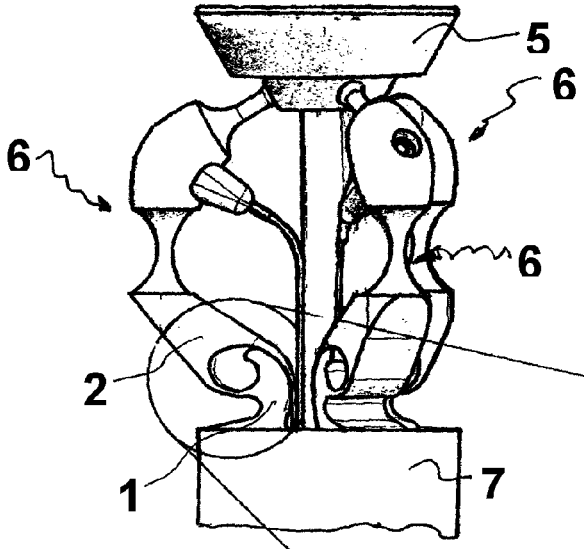
FIGS. 3 and 3A are a side view and a detail thereof, respectively, of a wire-operated mobile platform using the hinge of the present invention.
Figure 3A:
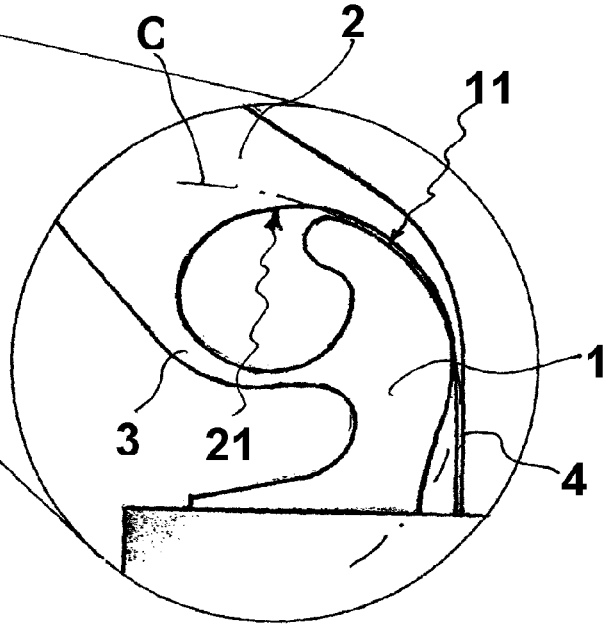
Figure 4:
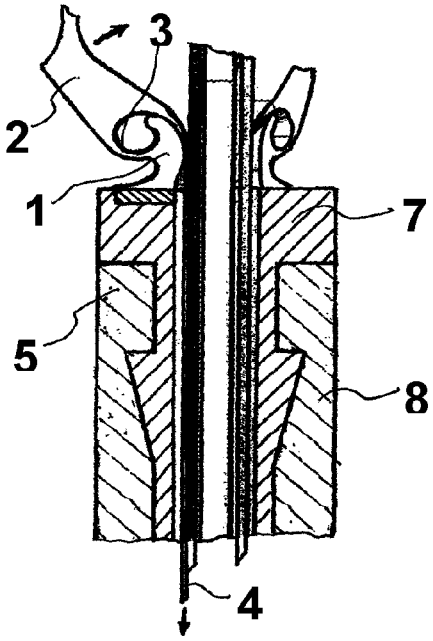
FIG. 4 is a sectional view showing the operation of the hinge according to the present invention in the platform of FIG. 3.

Then, with reference to FIGS. 3, 3A and 4, a first example of use of the hinge according to the present invention is shown. As previously suggested, the use of high precision and repeatability selective compliance hinge can be applied—e.g.—in the field of endoscopic surgery and, in the above mentioned figures, a wire-operated platform using selective compliance hinges according to the present invention is shown, e.g. for catheterizations, biopsies and endoscopic surgery.

The platform is generally shown with the reference 5 and it is mounted on three arms 6, each one being operated by independently moving wires. One degree of freedom of each arms is selected by a hinge according to the present invention, as shown in detail in FIG. 3A, wherein the coupled surfaces 111 and 211 can be seen, again developing along arcs of the circle C.

The first body 1 is then rigidly connected to a base 7, in turn fixed to an endoscopic tube 8, shown in FIG. 4. The second body 2 is then connected to the other elements forming the arm 6 and connects to the platform 5. Accordingly, the relative moment of the second body 2, relative to the first body 1 fixed to the base 7, provides a displacement of the platform 5. Since the hinge according to the present invention allows precise and repeatable movements, also the platform could be moved analogously, thus allowing to operate the displacements of the platform with the greatest precision.

Moreover, the movement of the hinge could be advantageously operated by a threadlike element 4 connected to the second body 2, extending inside the endoscopic tube 8. As shown in FIG. 4, the rotation of second body 2 will be operated by pulling the threadlike element 4 and, as a consequence, the platform 5 will be moved.

Figure 5:
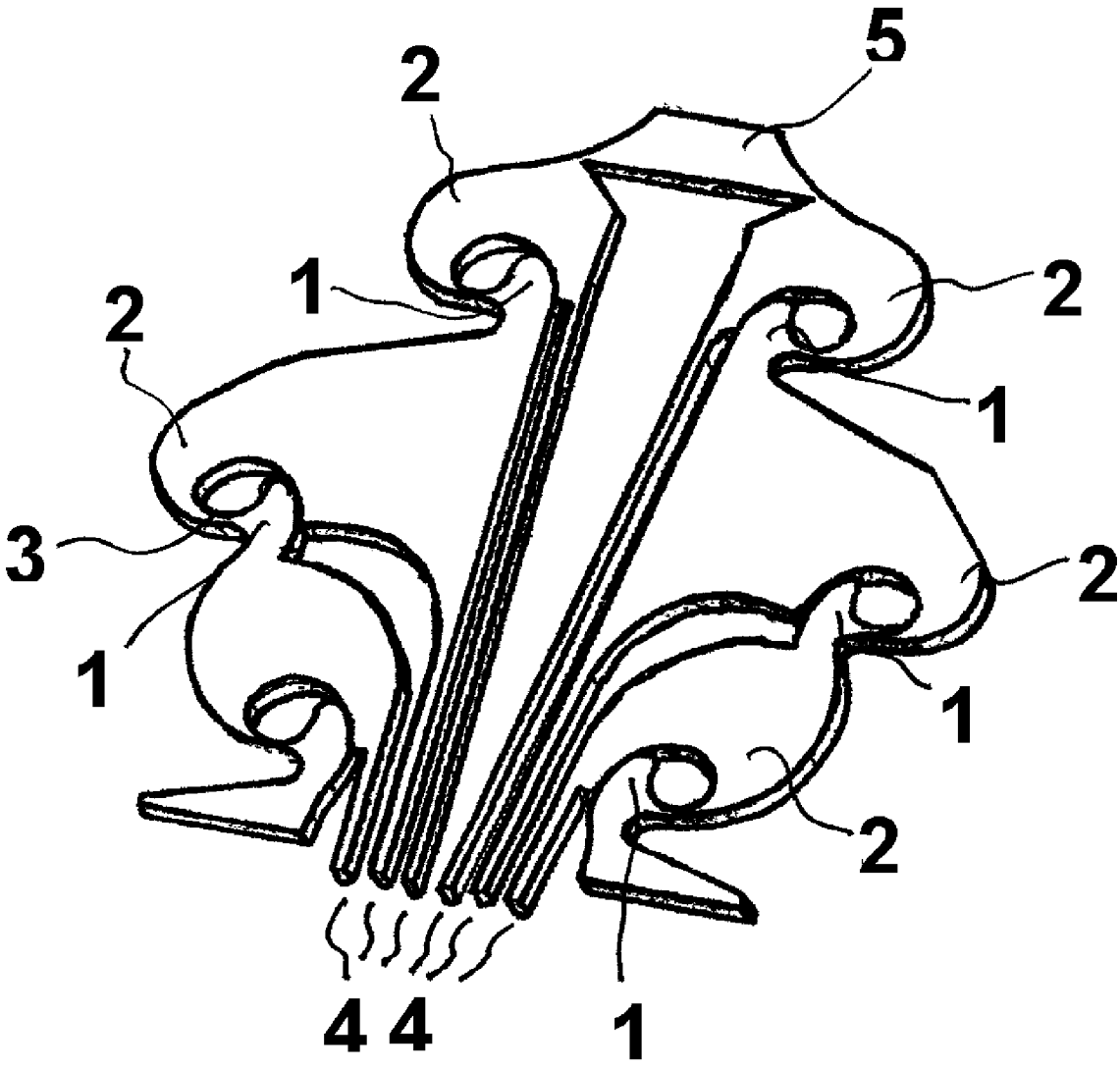
FIG. 5 is a perspective view showing a possible embodiment of a planar mobile platform using the hinge according to the present invention.

A second example of use is described in FIG. 5, showing a mechanism for a planar moving of a platform 5. Clearly, platform 5 has three degrees of freedom in a plane, that could be redundantly operated by six, five or four operation wires, or without redundancy with three operation wires. The embodiment with six degrees of control is shown in FIG. 5, allowing the greatest positioning precision. The six hinges, placed in appropriate positions, provides to the platform a suitable mobility. In the case of six, five or four operating wires are used, the control has a partial redundancy, that could be used for improving the precision, minimizing the storing of elastic energy, and for ensuring the greatest bi-directionality in rotations. In the case of only three operation wires are used, the control is not redundant (three degrees of freedom for three independent actuators) the stability of the structure being anyhow ensured by the connecting elements 3, that always have an equilibrium configuration even if they are flexible. In this case, an equilibrium configuration of the structure in FIG. 5 is certainly the neutral configuration (without pulling the wires) wherein the narrowed portions are not bent.

Said mechanism is made as a single body, defining by its particular structure six pairs of bodies 1 and 2, connected by respective connecting elements 3.

Therefore, it should be noted that, in this case, the hinge according to the present invention allows to provide a mechanism for planar moving using a single body that could be easily and economically made by molding. The sturdiness of the assembly prevent incidental bending deforming the system outside the plane of motion.

Moreover, it will be understood that the present invention is susceptible of several variants and embodiments alternative to the ones described hereto, some of which are briefly described hereinafter with reference to the sole aspects distinguishing them by the embodiments considered hereto.

Figure 6:
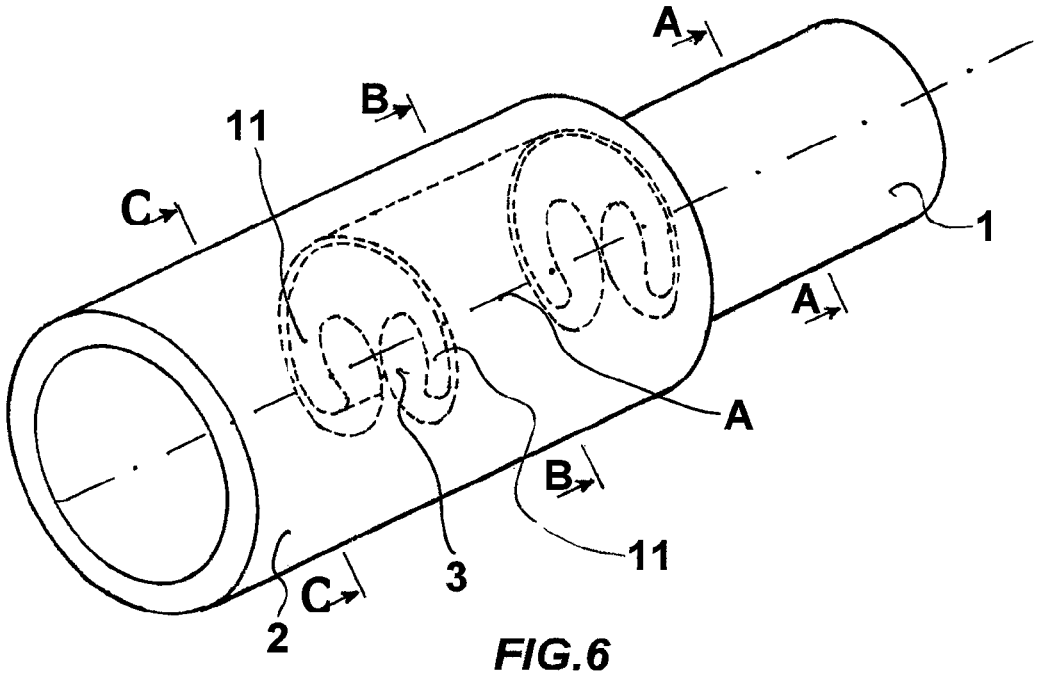
FIG. 6 is a partially transparent perspective view of an alternative embodiment of the hinge according to the invention.
Figure 7A:
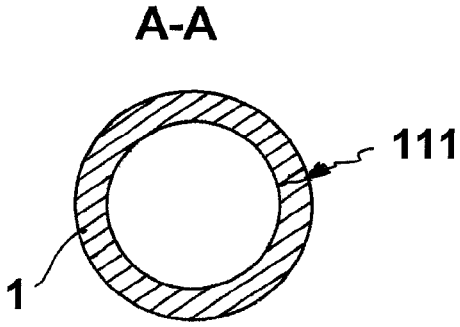
FIGS. 7A, 7B and 7C show sections of the hinge in FIG. 6 along planes A-A, B-B and C-C, respectively.
Figure 7B:
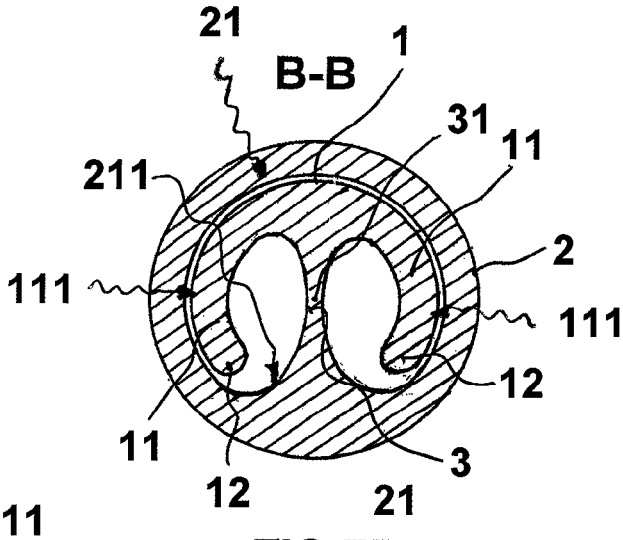
Figure 7C:
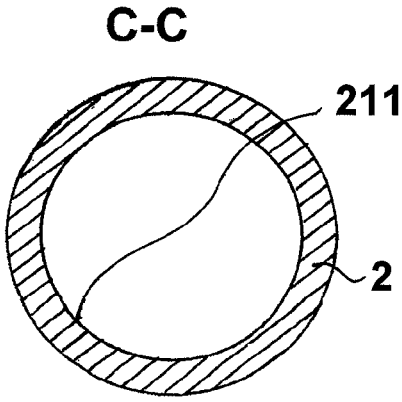

In particular, with reference to FIG. 6, the hinge according to the present invention further allows to provide turning pair between two bodies 1 and 2 being concentric about their axis of relative rotation A. Even in this case, bodies 1 and 2 are made as a single body and have a tubular shape. At the connecting area B-B there are the kinematic elements in the strict sense of the word made by the extension 11, which is consequently considered part of the body 1, and by the extension 21 of the body 2, which, in this case, is shaped as a hollow cylindrical area, as shown in FIG. 7B. The extension 11 rotates relative to the body 2, about axis A, the surface 112 sliding relative to the surface 211. At the same time, besides the above mentioned kinematic elements, the flexible connecting element 3 is provided between the bodies 1 and 2, again in the central area B-B. The element develops inside a cave provided within the extension 11.

It should be noted that, in this case, the extensions 11 are advantageously symmetrical to the connecting element 3. The surface 211 is provided within the extension 21, while the surface 112 is provided outside the extension 11. In the section of the conjugate cylinder, along plane B-B, the sliding circle correspond to the circle C, the center thereof corresponding to the axis A trace.

Moreover, it should be noted that in this case means for limiting the range of the rotary motion is provided by the ends 12 of the symmetric extensions 11, each of them limiting the rotary motion in a direction of rotation by entering into contact with the surface 211 at the connecting element 3.

Therefore, this embodiment advantageously allows to provide a turning pair by selective deformation between two coaxial bodies in an extremely precise and, moreover, strong way.

The present invention has hereto been described with reference to preferred embodiments thereof. It is understood that there could be other embodiments referable to the same inventive kernel, all falling within the protective scope of the claims set forth hereinafter.

The invention claimed is:

1. A selective compliance hinge, apt to define a turning pair with a default axis of rotation, comprising a connecting element compliant between a first and a second body, each of said bodies having a first and a second extension, respectively, said extensions comprising respective surfaces conjugate therebetween and developing substantially along arcs of a circle, so that said surfaces slide one relative the other remaining adjacent therebetween and defining a rotary motion taking place substantially about said default axis of rotation, said center of said circle being placed substantially at a barycenter of elastic quantities of the connecting element.

2. The selective compliance hinge according to claim 1, wherein said first and second bodies defines a center of mutual rotation substantially placed at the barycentre of elastic quantities of the connecting element, said center of mutual rotation being substantially corresponding to the center of said rotary motion.

3. The selective compliance hinge according to claim 1, wherein said first extension has a shape of extended projection apt to be housed in a recess defined by said second extension and by said connecting element.

4. The selective compliance hinge according to claim 2, wherein said first extension has a shape of extended projection apt to be housed in a recess defined by said second extension and by said connecting element.

5. The selective compliance hinge according to claim 1, wherein said surfaces are concave and convex, respectively, and have a bending substantially equal to said circle.

6. The selective compliance hinge according to claim 1, comprising means apt to limit the range of said rotary motion.

7. The selective compliance hinge according to claim 6, wherein said means apt to limit said rotary motion, comprises an end of said first extension, apt to enter into contact with a surface of the second extension, in order to limit the range of said rotary motion.

8. The selective compliance hinge according to claim 6, wherein said means apt to limit said rotary motion, comprises a side surface of said second extension, apt to enter into contact with said first body, in order to limit the range of said rotary motion.

9. The selective compliance hinge according to claim 1, wherein said first and second bodies and said connecting element are made as a single body.

10. The selective compliance hinge according to claim 1, wherein said connecting element is in the for of a narrow section region.

11. The selective compliance hinge according to claim 1, wherein said first and second bodies are tubular shaped and are coaxial, so that said first body is partially or fully inserted in said second body at said extension of the first body.

12. A selective compliance hinge, apt to define a turning pair with a default axis of rotation, comprising a connecting element compliant between a first and a second body, each of said bodies having a first and a second extension, respectively, said extensions comprising respective surfaces conjugate therebetween and developing substantially along arcs of a circle, so that said surfaces slide one relative the other remaining adjacent therebetween and defining a rotary motion taking place substantially about said default axis of rotation, wherein said first and second bodies defines a center of mutual rotation substantially placed at the barycentre of elastic quantities of the connecting element, said center of mutual rotation being substantially corresponding to the center of said rotary motion, said center of said circle being placed substantially at a barycenter of elastic quantities of the connecting element.

13. The selective compliance hinge according to claim 12, wherein said surfaces are concave and convex, respectively, and have a bending substantially equal to said circle.

14. The selective compliance hinge according to claim 12, comprising means apt to limit the range of said rotary motion.

15. The selective compliance hinge according to claim 14, wherein said means apt to limit said rotary motion, comprises an end of said first extension, apt to enter into contact with a surface of the second extension, in order to limit the range of said rotary motion.

16. The selective compliance hinge according to claim 14, wherein said means apt to limit said rotary motion, comprises a side surface of said second extension, apt to enter into contact with said first body, in order to limit the range of said rotary motion.

17. The selective compliance hinge according to claim 12, wherein said first and second bodies and said connecting element are made as a single body.

18. The selective compliance hinge according to claim 12, wherein said connecting element is in the form of a narrow section region.

19. The selective compliance hinge according to claim 12, wherein said first and second bodies are tubular shaped and are coaxial, so that said first body is partially or fully inserted in said second body at said extension of the first body.

* * * * *